United States Patent [19]

Gaumer

[11] 4,382,366

[45] May 10, 1983

[54] AIR SEPARATION PROCESS WITH SINGLE DISTILLATION COLUMN FOR COMBINED GAS TURBINE SYSTEM

[75] Inventor: Lee S. Gaumer, Allentown, Pa.

[73] Assignee: Air Products and Chemicals, Inc., Allentown, Pa.

[21] Appl. No.: 328,325

[22] Filed: Dec. 7, 1981

[51] Int. Cl.[3] ..... F25J 13/02

[52] U.S. Cl. ..... 62/31; 60/648; 62/34; 62/39

[58] Field of Search ..... 62/38, 39, 9, 11, 12, 62/13, 17–19, 23, 24, 25, 26–30, 31–34, 42–44; 60/648

[56] References Cited

U.S. PATENT DOCUMENTS

| | | | |
|---|---|---|---|
| 2,520,862 | 8/1950 | Swearingen | 62/38 |
| 3,214,926 | 11/1965 | Shaievitz et al. | 62/14 |
| 3,217,502 | 11/1965 | Keith, Jr. | 62/13 |
| 3,394,555 | 7/1968 | LaFleur | 62/29 |
| 3,731,495 | 5/1973 | Coveney | 62/39 |
| 3,950,957 | 4/1976 | Zakon | 60/648 |
| 4,152,130 | 7/1979 | Theobald | 62/18 |
| 4,254,629 | 3/1981 | Olszewski | 62/13 |

*Primary Examiner*—Frank Sever

*Attorney, Agent, or Firm*—Geoffrey L. Chase; J. C. Simmons; E. E. Innis

[57] ABSTRACT

The present invention is directed to an air separation system for the recovery of pressurized, substantially pure oxygen gas. The system uses a single pressure distillation column and burns a nitrogen-oxygen waste stream to provide power for the air compressor, the oxygen product compressor and electric generation. The distillation column has a split feed to develop reflux and reboil and to provide initial separation of the liquid and vapor components of the column.

7 Claims, 1 Drawing Figure

AIR SEPARATION PROCESS WITH SINGLE DISTILLATION COLUMN FOR COMBINED GAS TURBINE SYSTEM

TECHNICAL FIELD

The present invention is directed to the separation of air into a substantially pure oxygen stream and an oxygen containing nitrogen waste stream which latter stream is subsequently combusted with a fuel in order to provide the power for compression necessary for the air separation. The invention also relates to a single pressure distillation column separation of air in order to obtain an oxygen product stream which is compressed by the energy obtained from the combustion of the waste stream from the air separation unit.

BACKGROUND OF THE PRIOR ART

Various processes have been known and utilized in the prior art for the separation of air into its nitrogen and oxygen dominant constituents. Additionally, the use of a single pressure distillation column is known to have been used in the prior art for such separations.

In U.S. Pat. No. 3,214,926 a method for producing liquid oxygen or liquid nitrogen is set forth. However, in the patent it is necessary to have two distillation columns, one at high pressure and another at low pressure in order to extract liquid oxygen. No teaching is set forth in the text of the patent in which compression is provided by the energy derived from the separation streams.

In U.S. Pat. No. 3,217,502 a system is described which utilizes a single pressure distillation column. The product of this air separation system is liquid nitrogen. Oxygen which is separated out in this system is vented to waste. In this patent, it is the oxygen waste stream which is expanded in order to provide refrigeration for the air separation system. Power recovery from the waste stream is not set forth.

An air separation unit for the production of oxygen is disclosed in U.S. Pat. No. 3,394,555 wherein the combustion of a separate fuel source such as powdered coal is burned with oxygen or an air-oxygen mixture in which the oxygen is derived from the air separation unit. This combustion process provides power for the compression of helium gas for refrigeration necessary to the cryogenic separation system. Power from such combustion is derived from a magnetohydrodynamic power generator. Only a single feed to the single stage distillation column is contemplated in this patent.

U.S. Pat. No. 3,731,495 discloses an air separation system using an air feed compressor which is powered by combustion gases directed through a turbine. The turbine exhaust heats boiler steam to supplement the compressor drive. Electric generation is also considered. However, this reference does not utilize split feeds to the distillation column and in fact utilizes two separate columns at separate pressures for the recovery of the individual gaseous components of air which are separated.

U.S. Pat. No. 4,152,130 discloses an air separation unit which has multiple feeds to a two pressure-two stage distillation column. Both feeds to the distillation column are expanded through an expander. The system may produce liquid oxygen or liquid nitrogen as desired. The recovery of power from a waste stream from the air separation unit is not contemplated.

Low purity oxygen is produced in an air separation unit described in U.S. Pat. No. 4,254,629. Split feeds of the air to be separated are contemplated by the patent, but the use of at least two columns at high and low pressure are necessary. The recovery of power by combustion from a waste stream from the separation unit is not taught.

The art as represented above has failed to disclose an efficient manner in which to separate oxygen from air with the utilization of the by-products or waste streams in order to recycle energy necessary for compression both of the feed air and the oxygen product. In addition, the prior art has failed to minimize capital expenditures in separating air by the utilization of a single pressure distillation column. The solution to problems such as these are the objectives of the present invention.

BRIEF SUMMARY OF THE INVENTION

The present invention is directed to a process for separating high purity oxygen from air in a single pressure column comprising the steps of compressing an air feed stream wherein the compressor is powered by a gas turbine, cooling the air feed stream in a reversing heat exchanger against a waste nitrogen stream and an oxygen product stream from said column, separating a side air feed stream from a remaining air feed stream and passing the side stream back through the heat exchanger to provide temperature unbalance to preclude carbon dioxide and water build-up in said exchanger, expanding and cooling the side stream in a turbine before introducing said stream into an intermediate point of said column, heat exchanging the remaining air feed stream with a liquid phase of the bottom of said column to condense said stream and reboil said liquid, further heat exchanging the remaining air feed stream against the overhead product stream of said column before introducing said remaining feed stream as reflux into the overhead of said column, removing at pressure a nitrogen waste stream containing a combustible level of oxygen from the top of said column as the overhead product stream, combusting said pressurized nitrogen waste stream with a fuel to provide a hot pressurized gas feed to said gas turbine which powers the feed air compressor, and removing a high purity oxygen product stream from the bottom of said column and pressurizing the same by a compressor driven by said gas turbine and a steam turbine wherein said steam turbine is provided with steam by cyclic heat exchange of the steam with the exhaust of the gas turbine.

It is an object of the present invention to generate oxygen from air in a single pressure column wherein the power requirement of the air compression necessary for the separation of the oxygen is derived from an oxygen containing waste nitrogen stream which is combusted with a fuel in order to power a turbine which in turn powers the air compressor.

It is another object of the present invention to provide split feeds to the single pressure distillation column wherein one feed is expanded through an expansion turbine and introduced into the column at an intermediate point, while the remaining feed is condensed in the bottom of the column and introduced into the overhead of the column for reflux.

It is a further object of the present invention to provide the energy for product oxygen compression from the same oxygen containing waste nitrogen stream which is combusted with fuel, wherein the combustion products are used to produce steam for the operation of a turbine drive for the oxygen compressor.

It is yet another object of the present invention to provide export electricity from the remaining power derived from the combustion of the oxygen containing waste nitrogen stream.

DETAILED DESCRIPTION OF THE INVENTION

Figure 1:
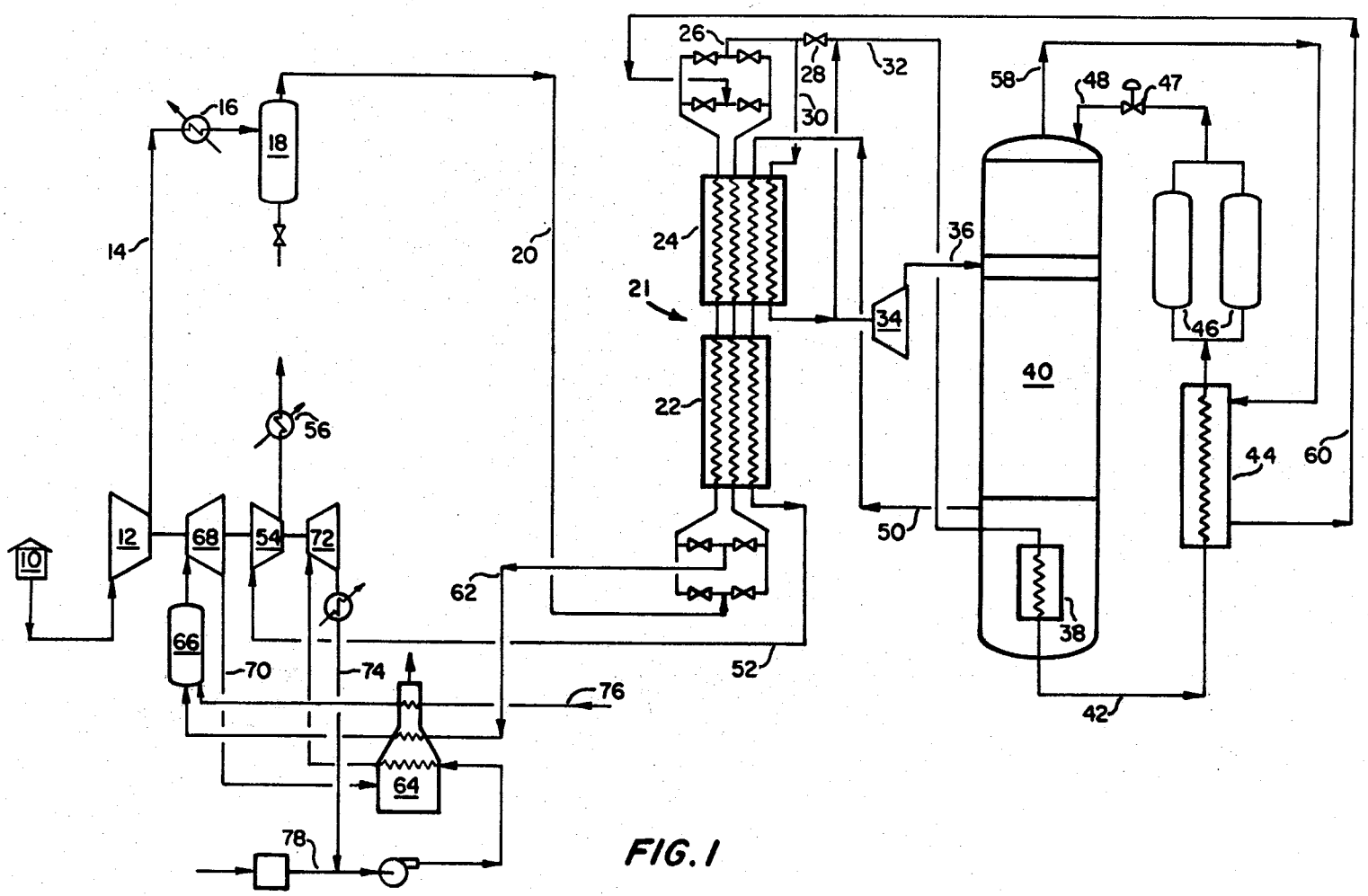
FIG. 1 consists of a flow sheet of the present invention which is an air separation unit which provides substantially pure oxygen product.

With reference to FIG. 1, the cryogenic oxygen generator is shown with a single pressure distillation column which operates at approximately 54 psig. Air is introduced into the separation unit through filter 10. The air is compressed to at least 160 psia in an air compressor 12 which is powered by a gas turbine 68. The air which is heated to a temperature of 360° F. (182° C.) is then directed through line 14 to be cooled in heat exchanger 16.

The cooled and compressed feed air stream is then separated from condensibles, such as water, in the separator vessel 18. The feed air is then conducted through line 20 to a reversing heat exchange unit 21 which consists of a warm heat exchange unit 22 and a cold heat exchange unit 24. In the reversing heat exchangers, the feed air stream is cooled and deposits condensibles, such as carbon dioxide and water, on the walls of the air feed conduit in such heat exchangers. This cooling is effected by heat exchange with the streams delivered from the distillation column. After a period of operation, the feed air stream and the waste nitrogen gas stream are reversed or switched such that the waste nitrogen gas stream flows through the conduit previously handling the feed air and removes any condensibles from the conduit walls, while the feed air stream then proceeds to condense out materials in the previously clean waste nitrogen gas conduit. This switching of conduit use in the reversing heat exchangers is carried out at set intervals continually during the air separation units operation. Such reversing heat exchangers are deemed to be well known in the prior art and no further operational explanation is deemed to be necessary.

The cooled air stream from the reversing heat exchangers in conduit 26 is split into a remaining stream 32 and a side stream 30, both of which are eventually introduced as feed into the distillation column. The side stream in conduit 30 is reintroduced into the cold end heat exchanger 24 in order to provide unbalance to the exchanger for the removal of carbon dioxide from the main feed air stream. This side stream 30 is then expanded through an expansion turbine 34 to produce refrigeration before being introduced through line 36 as vapor feed to the distillation column 40. This side stream is introduced at an intermediate point of the distillation column.

The remaining stream passes through a valve 28 and is conducted through line 32 to the bottom of the distillation column 40 wherein the remaining stream passes through a reboiler 38 and warms the liquid in the base of the distillation column 40 by heat exchange sufficiently to provide rising vapor reboil in the column and to condense said stream. The remaining stream is further cooled by this reboiling operation and is removed from the bottom of the column through line 42. The remaining stream in line 42 is heat exchanged against the oxygen containing nitrogen waste stream from the top of said column 40 in a heat exchanger 44. The remaining stream then passes through paired beds of solid absorbent in containers 46 in order to remove hydrocarbon and residual carbon dioxide. The stream then passes through a pressure reduction valve 47 before being introduced into the top of the distillation column to provide liquid reflux.

The vapor, which boils off the liquid oxygen contained in the bottom of the distillation column due to the heat exchange of the remaining feed air stream in the reboiler with such liquid oxygen, separates into two parts. One part is taken off as gaseous oxygen product in line 50, while the second part continues to form a stripping vapor rising through the bottom section of the column. The stripping vapor after being contacted on successive contacting trays with the down flowing liquid reflux, leaves the bottom section of the column and combines with the air feed to the intermediate portion of the column from the turbo expander, and the combined vapor streams pass through the upper section of the column being contacted on successive distillation trays with the down flowing liquid reflux. A waste stream of nitrogen and oxygen gas leaves the top of the column and is in equilibrium with the liquid reflux introduced into the column.

The oxygen containing nitrogen waste stream removed from the overhead of the column in line 58 is heat exchanged and warmed by the feed to the overhead portion of the column in heat exchanger 44. The warmed waste stream in line 60 is then further warmed in the reversing heat exchangers 22 and 24. During passage through these heat exchangers, the warmed waste nitrogen stream picks up moisture and carbon dioxide which have been deposited in the switching conduit which the waste nitrogen stream is passing through in said heat exchangers. In a similar flow path, the oxygen product gas from the lower portion of the distillation column is removed through line 50 and also warmed in the heat exchangers 22 and 24 in a non-reversing or non-switching conduit. The rewarmed oxygen product then leaves the heat exchangers 22 and 24 in line 52 wherein it is compressed to pipeline pressure in oxygen compressor 54 before being aftercooled in heat exchanger 56. The oxygen product leaves the system at 350 psia with a molar concentration as follows:

Oxygen: 99.6%
Argon: 0.4%
Nitrogen: 0.0%

The oxygen compression is powered by a gas expansion turbine driven by hot combustion gases as explained below. After being rewarmed in the heat exchanger 21, the oxygen containing nitrogen waste stream containing some moisture and carbon dioxide is directed through a combined boiler and heat recovery vessel 64 in line 62. The waste nitrogen stream is further warmed against the combustion gases in said boiler 64. The warmed waste nitrogen gas stream is then introduced into a combuster 66 where it is combined with an outside fuel source 76 and burned in the combuster 66 to provide a hot gas which is fed through a hot gas expansion turbine 68 which powers the initial air compressor 12 as well as a portion of the load for running the oxygen compressor 54. The expanded hot gases coming from the turbine 68 are fed through line 70 to the boiler and heat recovery vessel 64. The hot expanded gases are heat exchanged with three separate streams which are passed through said vessel 64. The first stream which is warmed in said vessel 64, is the fuel flowing to the combuster 66 from the fuel source 76. Additionally, the oxygen containing waste nitrogen gas stream which is burned in conjunction with the fuel in combuster 66 is also prewarmed in the boiler and heat recovery vessel 64. In this manner, the turbine driving gases from the combuster 66 take advantage of the combusted gas by-products by recovering heat value for such combustion feeds prior to the actual combustion. This improves the efficiency of the combustion and subsequent turbine utilization of the combustion products.

Yet another heat exchange is made in the boiler and heat recovery vessel 64 by the flow of water into said vessel in a heat exchange manner in order to produce steam for the driving of yet another turbine 72 which provides the other portion of the drive power for the oxygen compressor 54. The expanded steam emanating from the turbine 72 is cooled and condensed in a heat exchanger and returned via line 74 to the boiler and heat recovery vessel 64. Make-up water from a source piped through line 78 is also combined, as needed, into this flow of water through line 74. Sufficient power is produced in the hot gas expansion turbine 68 and the steam turbine 72 to run both the air compressor 12 and the oxygen compressor 54 with residual power left to run an electric generator, which is not shown. This electric generator recovers the remaining power available from the combustion gases and the steam and such electric power can be used to run various equipment of the present flow scheme or is available for export.

The oxygen product leaving the bottom of the distillation column 56 can be pure oxygen or of lesser purity as desired. The column operates at approximately 54 psia if 99.5 volume percent of pure oxygen is desired. The column can be operated at a higher pressure if lower purity oxygen is desired.

The ability to achieve the objectives stated above by the use of a single distillation column operating at approximately 54 psia in the case of 99.5 volume percent pure oxygen product, is achieved by feeding the air from the turbo expander 34 to an intermediate distillation tray in the column 40. This permits a higher reflux ratio of liquid to vapor in the bottom section of the column in which the difficult separation of oxygen from argon and reduced amounts of nitrogen must be achieved. It also allows a lower ratio of liquid to vapor in the upper section of the column in which the much easier separation of nitrogen from oxygen and insignificant argon content must be achieved.

The present invention has been described with reference to a preferred embodiment thereof. However, this embodiment should not be considered a limitation on the scope of the invention, which scope should be ascertained by the following claims.

I claim:

1. A process for separating high purity oxygen from air in a single pressure distillation column comprising the steps of:

(a) compressing an air feed stream wherein the compressor is powered by a gas turbine, (b) cooling the air feed stream in a reversing heat exchanger against a nitrogen waste stream from said column and an oxygen product stream, (c) separating a side air feed stream from a remaining air feed stream and passing the side stream back through the heat exchanger to provide a temperature unbalance to preclude carbon dioxide and water buildup in said exchanger, (d) expanding and cooling the side stream in a turbine before introducing said stream into an intermediate point of said column, (e) heat exchanging the remaining air feed stream with the liquid phase of the bottom of said column to condense said stream and reboil said liquid, (f) further heat exchanging the remaining air feed stream against the overhead product stream of said column before introducing said feed stream as reflux into the top of said column, (g) removing, at pressure, a nitrogen waste stream containing a combustible level of oxygen from the top of said column as the overhead product stream of step (f), (h) combusting said pressurized nitrogen waste stream with a fuel to provide a hot pressurized gas feed to said gas turbine of step (a), (i) removing a high purity oxygen product stream from the bottom of said column and pressurizing the same by a compressor driven by a steam turbine wherein said steam turbine is provided with steam by a cyclic heat exchange of the steam with the exhaust of the gas turbine.

2. The invention of claim 1 wherein the nitrogen waste stream is passed through the reversing heat exchanger to remove carbon dioxide and water before combusting said stream for the gas turbine.

3. The invention of claim 1 or 2 wherein the fuel and the nitrogen waste stream are heat exchanged with the gas turbine exhaust before combustion.

4. The invention of claim 1 wherein the waste nitrogen stream removed from the column overhead is in equilibrium with the remaining air feed stream introduced into the top of the distillation column as reflux.

5. The invention of claim 1 or 2 wherein the gas turbine drives the air compressor and a generator for the production of electricity for export or process requirements.

6. The invention of claim 1 or 2 wherein the oxygen product stream is indirectly heat exchanged with said air feed in the reversing heat exchangers.

7. The invention of claim 1 wherein the intermediate point introduction of the expanded side feed air stream occurs at a column tray level sufficient to increase the liquid/vapor reflux ratio to separate argon as well as nitrogen from oxygen.

* * * * *